US005348090A

United States Patent [19]

Leismer

[11] Patent Number: 5,348,090

[45] Date of Patent: Sep. 20, 1994

[54] EXPANDED SLIP WELL ANCHOR

[75] Inventor: Dwayne D. Leismer, Pearland, Tex.

[73] Assignee: Camco International Inc., Houston, Tex.

[21] Appl. No.: 63,619

[22] Filed: May 18, 1993

[51] Int. Cl.[5] ..... E21B 23/08

[52] U.S. Cl. ..... 166/211; 166/212; 166/217; 166/215

[58] Field of Search ..... 166/120, 131, 134, 118, 166/206, 212, 217, 383, 211, 215

[56] References Cited

U.S. PATENT DOCUMENTS

| | | | |
|---|---|---|---|
| 2,382,455 | 8/1945 | Turechek | 166/217 |
| 3,602,306 | 8/1971 | Alexander | 166/217 |
| 3,669,187 | 6/1972 | Alexander | 166/217 |
| 3,889,750 | 6/1975 | Mullins | 166/217 |
| 3,912,006 | 10/1975 | Notter | 166/216 |
| 4,437,517 | 3/1984 | Bianchi et al. | 166/120 |
| 4,488,595 | 12/1984 | Akkerman | 166/134 X |
| 4,813,486 | 3/1989 | Wyatt et al. | 166/120 X |

*Primary Examiner*—Roger J. Schoeppel
*Attorney, Agent, or Firm*—Fulbright & Jaworski

[57] ABSTRACT

A well anchor having a body with a mandrel movably extending therethrough with first and second slips connected to the mandrel. Each of the slips includes a wedge surface and the wedge surfaces engage each other whereby movement of the first and second slips toward each other will expand the slips outwardly. The wedge surfaces are at an angle to and extend across the longitudinal axis of the body for maximizing expansion.

13 Claims, 4 Drawing Sheets

Fig. 1C
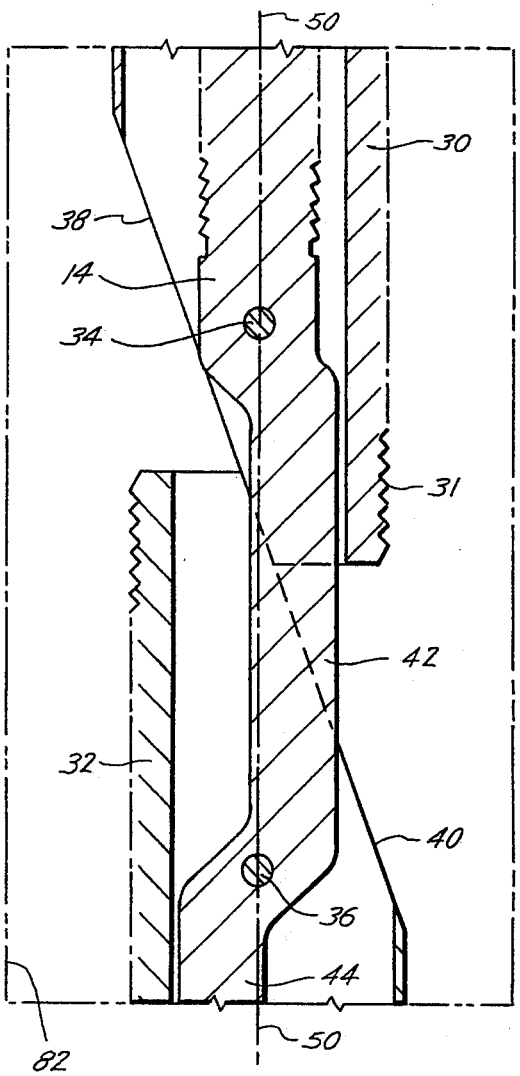
Fig. 1D
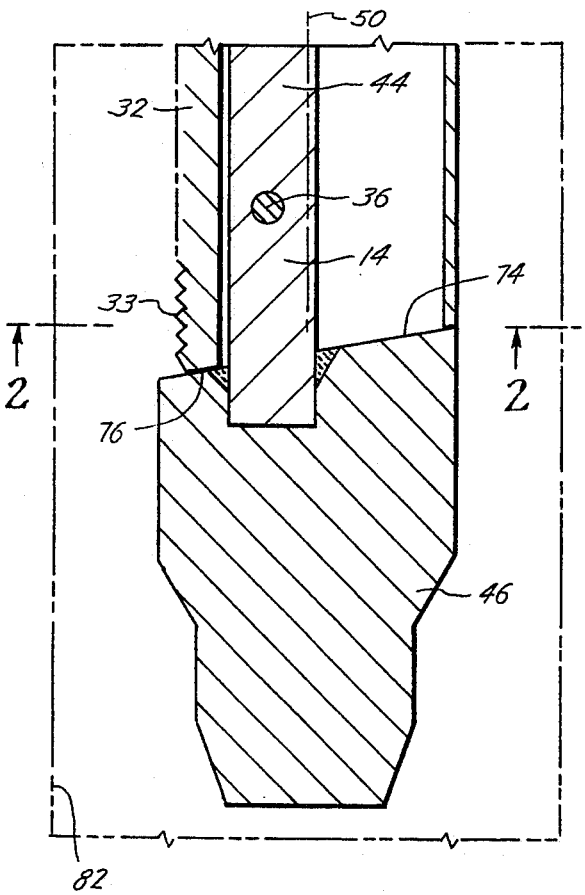
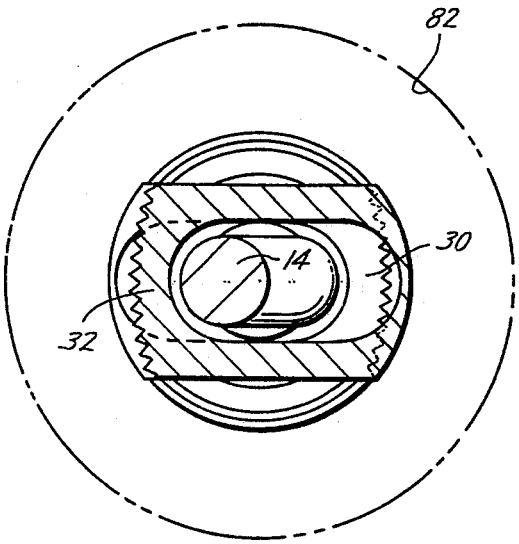
Fig. 2

EXPANDED SLIP WELL ANCHOR

BACKGROUND OF THE INVENTION

The present invention is directed to an expanded slip well anchor for anchoring in a well having first and second slip means which wedge against each other at an angle across the longitudinal axis of the body. Preferably the combined length of the wedge surfaces extend across the entire cross section of the anchor for maximizing the expansion of the slip means.

It is well known to utilize slip means in a well anchor which are wedged outwardly against cones for anchoring in wells such as in tubing and casing. However, such cone and slip expansion arrangements provide only limited expansion.

The present invention is directed to providing a well anchor which may be expanded from a minimum outside diameter and outwardly to a maximum diameter. For example only, while such a well anchor may have various other applications, it will be particularly useful in running through a production tubing in an oil and/or gas well in a retracted position, out of end of the tubing, and expanded to engage and anchor on the inside of the well casing. In such an application the anchor would be particularly useful for supporting tools such as a whipstock positioned thereabove for directional drilling through the casing.

SUMMARY OF THE INVENTION

The present invention is directed to an expanded slip well anchor for anchoring in a well and includes a body, and a mandrel extending through the body and longitudinally movable relative to the body. First and second slip means are connected to the mandrel and the slip means each includes a wedge surface. The wedge surfaces engage each other whereby movement of the first and second slip means towards each other will expand the first and second slip means outwardly. The wedge surfaces are at an angle to and extend across the longitudinal axis of the body. Preferably each of the wedge surfaces extend across one side of the longitudinal axis of the body to the outside of the respective slip means. And for further maximizing the expansion capability, it is preferred that the combined length of the wedge surfaces extend across the entire cross section of the anchor.

Yet a further object of the present invention is wherein the slip means are releasably connected to the mandrel.

Still a further object of the invention is the provision of a stop member connected to the mandrel below the first and second slip means for engaging and aiding in setting the slip means.

Yet a further object of the present invention is wherein the body includes a surface engagable with a top surface of the first slip means and the stop member includes a surface engagable with a bottom surface of the second slip means whereby the slip means will hold, in the expanded position, against either upward or downward forces. One of and preferably both of the coacting engaging surfaces between the body and the top of the first slip means and the coacting engaging surfaces between the stop and the bottom of the second slip means are directed at an angle to the longitudinal axis of the body whereby the slip means will exert a greater outward force upon rotation of the anchor.

Yet a further object of the present invention is wherein the first and second slip means encircle the mandrel for preventing loss of the slip means from the anchor.

Still a further object of the present invention is wherein the mandrel includes first and second offsets for allowing greater expansion of the first and second slip means respectively.

Still a further object of the present invention is the provision of rachet means between the body and the mandrel for holding the anchor in the set position when the body and the mandrel are moved relative to each other in setting the anchor. Preferably the body includes first and second parts longitudinally movable relative to each other and the rachet means engages the first part. The invention includes energy storing means positioned between the first and second parts for biasing the slip means into the set position.

Still a further object of the present invention is the provision of spring means between the first part of the body and the rachet opposite the engagement of the rachet with the body for taking up any backlash in the rachet.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIGS. 1A, 1B, 1C and 1D are continuations of each other and form an elevational view, in cross section, of the anchor of the present invention in position for running in a well, FIG. 2 is a cross sectional view taken along the line 2—2 of FIG. 1D, FIGS. 3A, 3B, 3C, and 3D are continuations of each other and form an elevational view, in cross section, of the anchor of FIGS. 1A–1D, positioned in a set position.

Figure 1A:
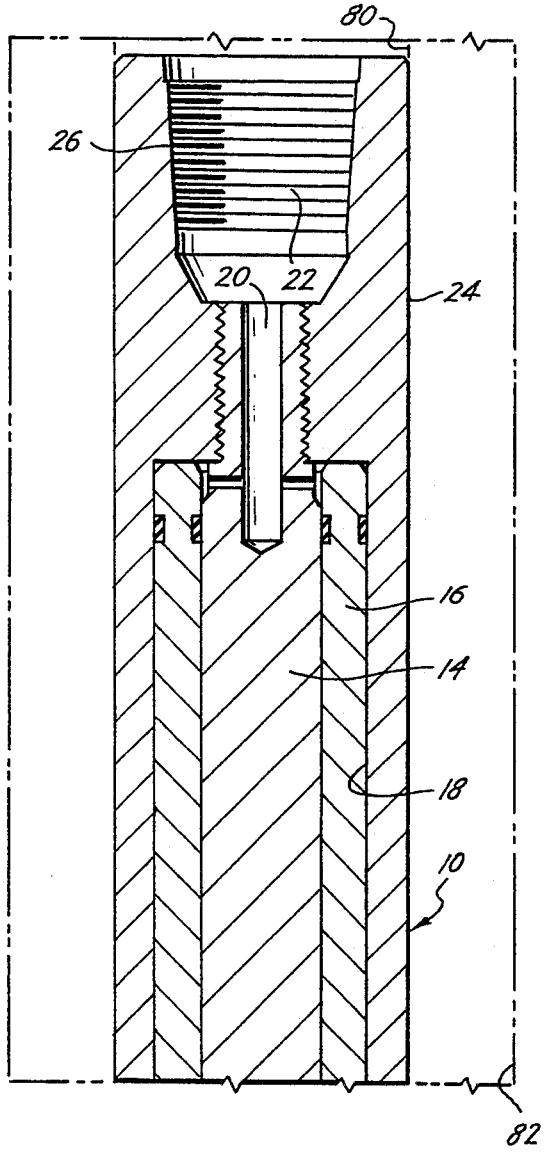

Referring now to the drawings, and particularly to FIGS. 1A–1D and 2 the reference numeral 10 generally indicates a well anchor of the present invention and generally includes a body 12 (FIG. 1B) and a mandrel 14 which extends through the body 12 and is longitudinally movable relative to the body 12 and as shown the mandrel 14 is stationary and the body is movable. Suitable mechanical or hydraulic means are provided for providing longitudinal movement of the body 12 and mandrel 14 relative to each other. In the embodiment shown a piston 16 is provided in a cylinder 18 and is exposed to hydraulic fluid through a passage 20 leading to the bore 22. Thus, in the present embodiment passage of hydraulic fluid through the passage 20 and against the piston 16 moves the body 12 relative to the mandrel 14. In this embodiment the mandrel 14 is threadably and preferably secured, such as by a pin or welding to a housing 24 having connecting means such as threads 26 for connection to a tubular member for supplying hydraulic fluid from the well surface to the piston 16. Obviously, the actuation of the body 12 relative to the mandrel 14 can be reversed by having the body 12 fixedly connected to the housing 24 and the mandrel 14 movable upwardly relative to the body 12 by a suitable piston.

The anchor 10 further includes a first slip means 30 and a second slip means 32 connected to and preferably releasably connected to the mandrel 14 by shear pins 34 and 36, respectively.

Figure 3A:
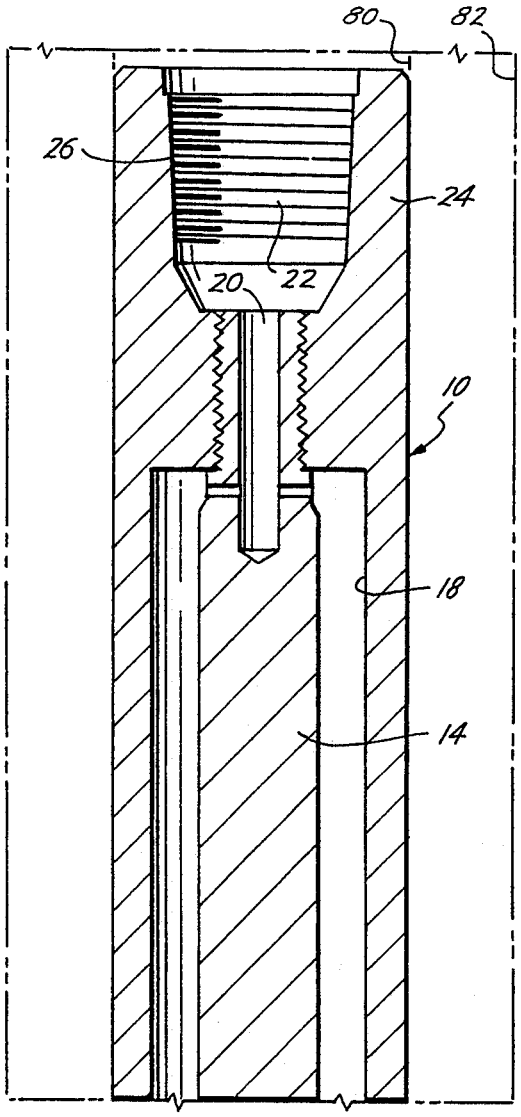
Figure 3B:
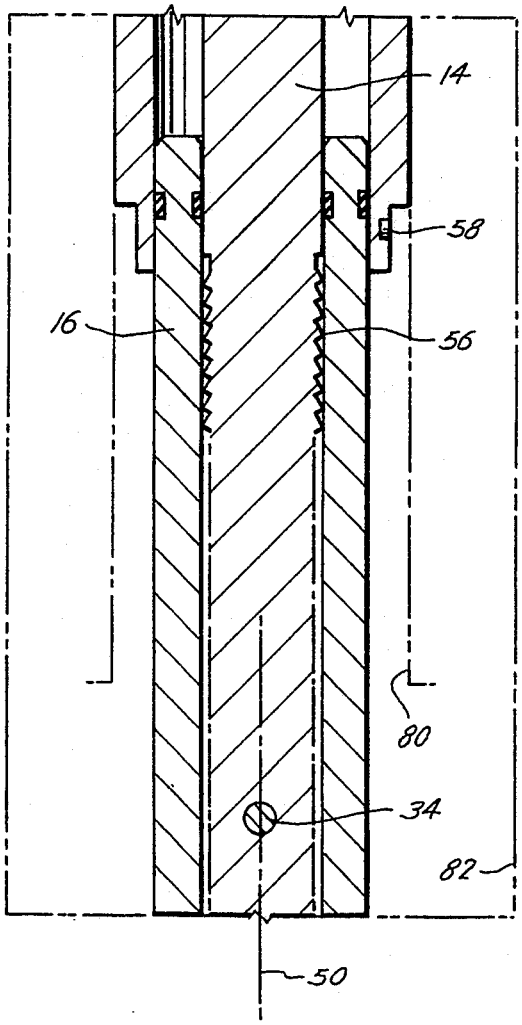
Figure 3C:
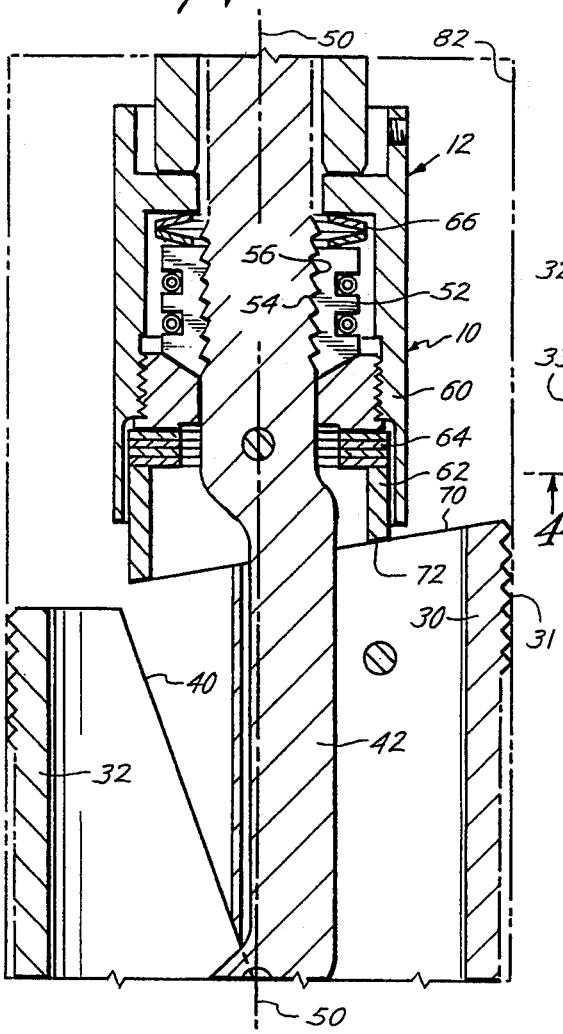

Referring to FIG. 1C each of the slip means 30 and 32 include a wedge surface. Thus slip 30 includes a wedge surface 38 and slip 32 includes a wedge surface 40. The wedge surfaces 38 and 40 engage each other whereby movement of the first slip 30 and the second slip 32 towards each other will expand the first and second slips 30 and 32 outwardly to an expanded position as best seen in FIGS. 3C and 3D.

In order to maximize the expansion of slips 30 and 32, the wedge surfaces 38 and 40 are at an angle to and extend across the longitudinal axis 50 of the anchor 10. That is preferably each of the wedge surfaces extend across one side of the longitudinal axis 50 of the anchor 10 and body 12 to the outside of their respective slips. That is, wedge surface 38 extends from the outside of slip 30 to across the axis 50. Similarly, wedge surface 40 extends across the outside of slip 30 to across the axis 50. And preferably the combined length of the wedge surfaces 38 and 40 extend across the entire cross section of the anchor 10 thereby maximizing the expansion of the slips 30 and 32.

Figure 3D:
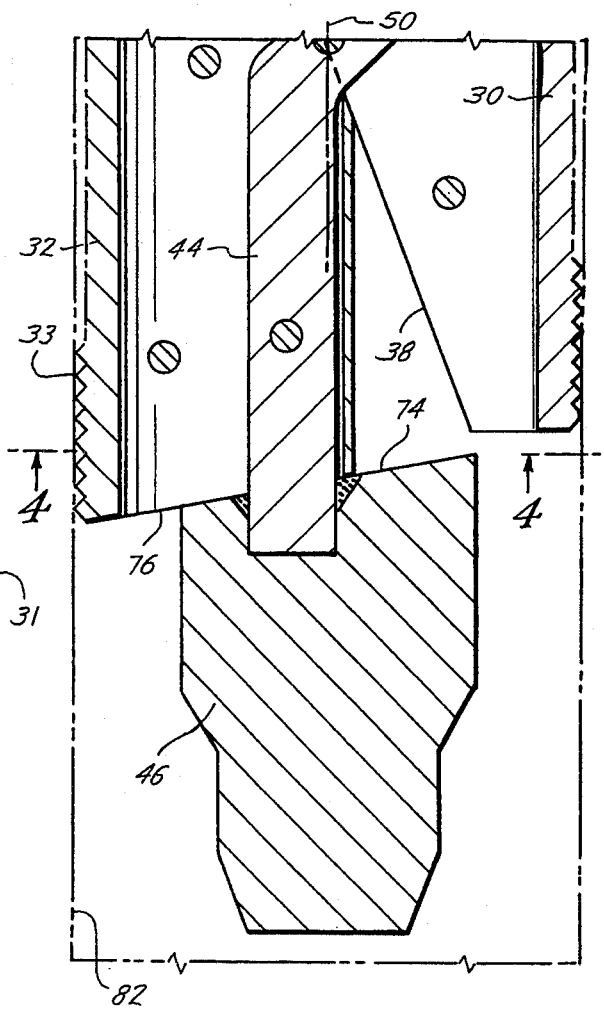
Figure 4:
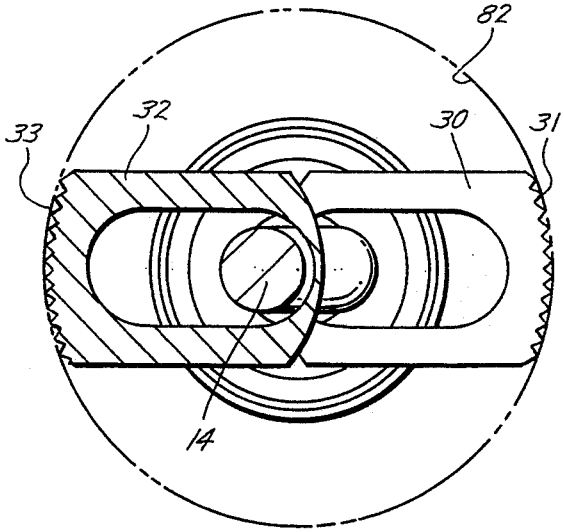
FIG. 4 is a cross sectional view taken along the line 4—4 of FIG.. 3D.

As best seen in FIGS. 2 and 4 it is preferable that the slips 30 and 32 encircle the mandrel 14 since they are released from the mandrel 14 upon setting by shearing of the shear pins 34 and 36. Therefore, by encircling the mandrel 14 they are secured from falling off and becoming dislodged therefrom. However, because the slips 30 and 32 encircle the mandrel 14, it is preferable that the mandrel 14 include longitudinal offsets 42 and 44 (FIG. 1C and 1D) to allow the slips 30 and 32 to more fully expand laterally, as best seen in FIGS. 3C and 3D.

Referring now to FIG. 1D and 3D a stop member 46 is connected to the mandrel 14 below the first and second slips 30 and 32. Thus when the body moves downwardly engaging the top of the first slip 30, the stop member 46 secured to the mandrel 14 supports the bottom of the second slip 32 thereby causing the first slip 30 and the second slip 32 to move towards each other and expand.

In order to hold the anchor 14 in the set position a spring loaded rachet 52 (FIG. 1B) having rachet teeth 54 engages teeth 56 on the mandrel 14. Initially the body 12 is held relative to the mandrel 14 by a shear pin 58, but on actuation of the piston 16 the body 12 moves downwardly relative to the mandrel 14 and stop member 46 pushing the slip 30 towards the slip 32. The relative longitudinal movement of the body 12 relative to the mandrel 14 is maintained by the rachet.

The body 12 consists of a first part 60 and a second part 62. Suitable energy storing means such as bellville springs 64 is positioned between the first part 60 and the second body part 62 thus maintaining a biasing force on the slip 30 by engaging the first body part 60 which is held in a downward position by the rachet 52. A spring 66 may be provided between the first body portion 60 and the rachet 52 for taking out any possible backlash between the rachet 50 and the teeth 56. Thus, with the stop member 46 engaging the bottom of the second slip 32 and the body 12 engaging the top of the slip 30 and with the rachet 52 locking the set position of the body 12 relative to the stop member 46 the anchor 10 will hold, and in fact will act to increase its expansion when it is subjected to either vertical upward or vertical downward forces.

Furthermore, the anchor 10 will not only exert an outward force when it is subjected to vertical loads, but will exert an outward force when subjected to rotational forces.

Figure 1B:
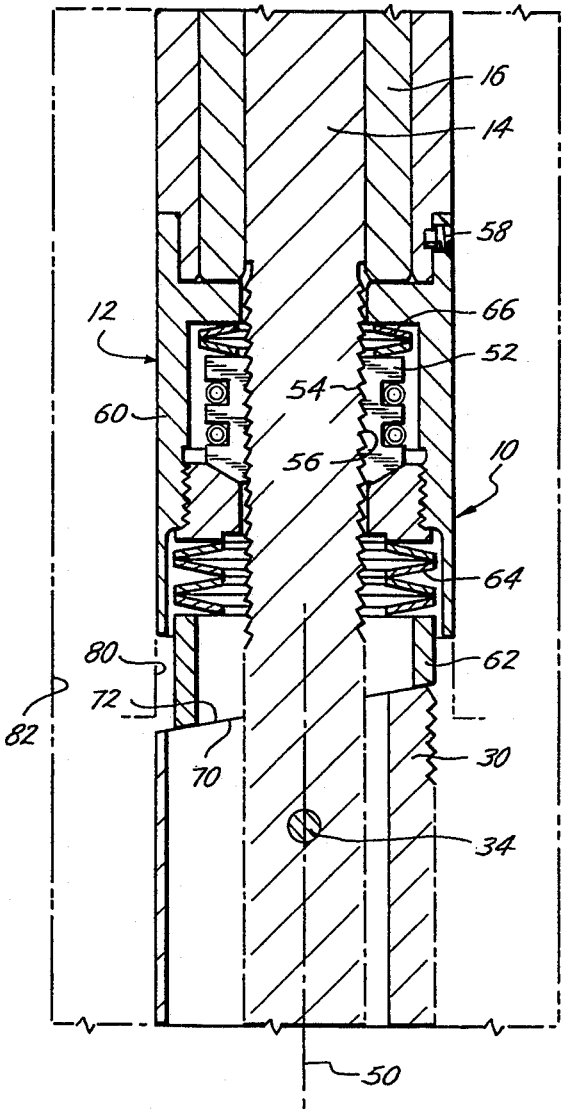

Referring to FIG. 1B the body 12 through its second body part 62 includes a surface 70 which engages the top surface 72 of the slip 30. It is to be noted that the coacting engaging services 70 and 72 between the body 12 and the top of the first slip 30 is directed at an angle to the longitudinal axis 50. Therefore, any rotational action between the body part 62 and the slip 30 will tend to force the slip 30 downwardly into a tighter engagement with the slip 32 resulting in a greater outward expansion and greater outward force applied to the slips 30 and 32. Similarly, and referring to FIG. 1D the stop member 46 includes a surface 74 engagable with the bottom surface 76 of the slip 32. Again, the coacting engaging services 74 and 76 are directed at an angle to the longitudinal axis 50. Thus if a rotational force is applied to the mandrel 14 and thus to the stop member 46 rotation between the stop member 46 and the slip 32 will exert a greater upward force on the slip 32 forcing it against the slip 30 thereby again tending to expand the slips 30 and 32 by exerting a greater outward force to prevent dislodgement of the set anchor. In this regard it is to be noted that it is preferable that the teeth 31 and 33 of the slips 30 and 32 respectively, are preferably a plurality of rows of pyramid shaped teeth having pointed ends for more securely holding and preventing rotation of the slips 30 and 32 when in the set position.

While the anchor 10 of the present invention may be used in many different applications in a well it is particularly well suited for running in the retracted position of FIGS. 1A–1D in a well production conduit 80 which is indicated in outline, and out the lower end of the production tubing 80 and expanded and set into a casing which is indicated in outline by the numeral 82. In running, the piston 16 is retracted, the body 12 is releasably secured to the housing 24 and thus to the mandrel 14 through the shear pin 58 and the slips 30 and 32 are in the retracted position for moving through the production tubing 80.

After the anchor 10 has moved downwardly and out of the production tubing 80 hydraulic fluid from the well surface is passed through the bore 22, the passageway 20 and acts against the piston 16 to move the body 12 downwardly relative to the mandrel 16 thus moving the slip 30 downwardly relative to the slip 32.

As best seen in FIGS. 3A–3D the shear pins 34 and 36 are sheared, the slips 30 and 32 move relative to each other on their coacting wedge surfaces 38 and 40 into an outward and set position against the inside of the casing 82. The energy storing spring 64 is compressed and the rachet 52 locks the body 12 relative to the stop member 46 thereby holding the anchor 10 in the set position. The anchor 10 is not released by either longitudinally upwardly or downwardly forces or torsional forces applied to the anchor 10.

The present invention, therefore, is well adapted to carry out the objects and attain the ends and advantages mentioned as well as others inherent therein. While a presently preferred embodiment of the invention has been for the purpose of disclosure, numerous changes in the details of construction, and steps of the process will be readily apparent to those skilled in the art, and which are encompassed within the spirit of the invention, and the scope of the appended claims.

What is claimed is:

1. An expanded slip well anchor for anchoring in a well comprising, a body, a mandrel extending through the body and longitudinally movable relative to the body, first and second slip means connected to the mandrel, said slip means each including a wedge surface, said wedge surfaces engaging each other whereby movement of the first and second slip means toward each other will expand the first and second slip means outwardly, and said wedge surfaces being at an angle to and extending across the longitudinal axis of the body.

2. The anchor of claim 1 wherein each of said wedge surfaces extend across the longitudinal axis of the body to the outside of their respective slip means.

3. The anchor of claim 1 wherein combined length of the wedge surfaces extend across the entire cross section of the anchor for maximizing the expansion of the slip means.

4. The anchor of claim 1 wherein said slip means are releasably connected to the mandrel.

5. The anchor of claim 1 including a stop member connected to the mandrel below the first and second slip means.

6. The anchor of claim 5 wherein the body includes a surface engagable with a top surface of the first slip means and the stop member includes a surface engagable with a bottom surface of the second slip means whereby the slip means will hold in the expanded position against either upward or downward forces.

7. The anchor of claim 6 wherein one of the coacting engaging surfaces between the body and the top of the first slip means and the coacting engaging surfaces between the stop and the bottom of the second slip means are directed at an angle to the longitudinal axis of the body whereby the slip means will exert a greater outward force upon rotation of the anchor.

8. The anchor of claim 6 wherein the coacting engaging surfaces between the body and the top of the first slip means and the coacting engaging surfaces between the stop and the bottom of the second slip means are directed at an angle to the longitudinal axis of the body whereby the slip means will exert a greater outward force upon rotation of the anchor.

9. The anchor of claim 1 wherein first and second slip means encircle the mandrel for preventing loss of the slip means from the anchor.

10. The anchor of claim 9 wherein the mandrel includes first and second offsets adjacent the first and second slip means, respectively, for allowing greater expansion of the first and second slip means, respectively.

11. The anchor of claim 1 including rachet means between the body and the mandrel for holding the anchor in a set position when the mandrel and body are moved relative to each other in setting the anchor.

12. The anchor of claim 11 wherein the body includes first and second parts longitudinally movable relative to each other and the rachet means engages the first part and including energy storing means positioned between the first and second parts.

13. The anchor of claim 12 including spring means between the first part of the body and the rachet opposite the engagement of the rachet opposite the engagement of the rachet with the body.

* * * * *